US009399564B2

(12) United States Patent
Hermann

(10) Patent No.: US 9,399,564 B2
(45) Date of Patent: Jul. 26, 2016

(54) ADJUSTABLE MODULE LIFT FRAME ASSEMBLY

(71) Applicant: PCL INDUSTRIAL MANAGEMENT INC., Edmonton (CA)

(72) Inventor: Ulrich (Rick) Hermann, Edmonton (CA)

(73) Assignee: PCL INDUSTRIAL MANAGEMENT INC., Edmonton, Alberta (CA)

( * ) Notice: Subject to any disclaimer, the term of this patent is extended or adjusted under 35 U.S.C. 154(b) by 0 days.

(21) Appl. No.: 14/555,976

(22) Filed: Nov. 28, 2014

(65) Prior Publication Data

US 2015/0291398 A1 Oct. 15, 2015

Related U.S. Application Data

(63) Continuation-in-part of application No. 14/351,009, filed as application No. PCT/CA2013/000662 on Jul. 19, 2013, now abandoned.

(60) Provisional application No. 61/704,219, filed on Sep. 21, 2012.

(51) Int. Cl.
*B66C 1/16* (2006.01)

(52) U.S. Cl.
CPC ..... *B66C 1/16* (2013.01)

(58) Field of Classification Search
CPC ..... B66C 1/12; B66C 1/16
USPC ..... 294/74, 81.3, 81.55, 67.4, 67.5
See application file for complete search history.

(56) References Cited

U.S. PATENT DOCUMENTS

| | | | | |
|---|---|---|---|---|
| 762,875 | A | 6/1904 | Blodgett | |
| 1,834,902 | A | 12/1931 | Payzant | |
| 1,928,213 | A | 9/1933 | Showers et al. | |
| 2,035,311 | A | 3/1936 | Creighton | |
| 2,550,218 | A * | 4/1951 | Brady | 294/81.55 |
| 2,818,296 | A * | 12/1957 | Brennan et al. | 294/81.55 |
| 3,314,711 | A | 4/1967 | Dietz et al. | |
| 3,343,861 | A | 9/1967 | Sinicki | |
| 3,558,175 | A | 1/1971 | Mattson | |
| 3,561,810 | A | 2/1971 | Newsted | |
| 3,596,968 | A | 8/1971 | Holm | |
| 3,602,544 | A | 8/1971 | Marsh | |
| 4,046,414 | A | 9/1977 | James et al. | |
| 4,185,862 | A | 1/1980 | Slocombe | |
| 4,462,627 | A | 7/1984 | Kudlicka | |
| 4,831,967 | A | 5/1989 | Anderson | |
| 5,037,151 | A * | 8/1991 | Kameyama et al. | 294/81.55 |
| 5,820,184 | A | 10/1998 | Echenay | |
| 5,836,632 | A * | 11/1998 | Pompa | 294/82.12 |

(Continued)

OTHER PUBLICATIONS

Northern Crane Services has invented specialized "QuikMod" module rigging (patent pending) to lift piperack modules up to 350 tons; www.NCSG.com; Nov. 2013.

*Primary Examiner* — Dean Kramer
(74) *Attorney, Agent, or Firm* — Bennett Jones LLP

(57) ABSTRACT

A module lift assembly includes a lift assembly, a pair of transversely spaced apart longitudinal lift beams and slings connecting the lift assembly to the lift beams. Each of slings is pivotally connected to the lift assembly and the connected lift beam, and is composed of pivotally connected elongate segments. Pivoting of the segments relative to each other, the lift assembly and the lift beams allows the lift assembly to be lowered and raised relative to the lift beams.

19 Claims, 15 Drawing Sheets

(56) References Cited

U.S. PATENT DOCUMENTS

| | | | | |
|---|---|---|---|---|
| 6,412,649 | B1 * | 7/2002 | Khachaturian | 212/242 |
| 7,497,492 | B2 | 3/2009 | Gonzalez et al. | |
| 8,317,244 | B1 | 11/2012 | Schuyleman | |
| 2001/0055523 | A1 | 12/2001 | Slodden et al. | |
| 2003/0222468 | A1 | 12/2003 | Brooks et al. | |
| 2011/0298232 | A1 * | 12/2011 | Reger | 294/81.5 |
| 2013/0020818 | A1 | 1/2013 | Parker | |
| 2013/0058754 | A1 * | 3/2013 | Lulker | 414/800 |

* cited by examiner

ADJUSTABLE MODULE LIFT FRAME ASSEMBLY

CROSS REFERENCE TO RELATED APPLICATIONS

This application is a continuation-in-part of U.S. patent application Ser. No. 14/351,009 filed on Apr. 10, 2014, and entitled "Adjustable Module Lift Frame Assembly", the contents of which are herein incorporated by reference, and which is the U.S. National Phase of PCT/CA2013/000662 filed on Jul. 19, 2013, which claims the priority benefit of U.S. Provisional Patent Application 61/704,219 filed on Sep. 21, 2012, and entitled "Adjustable Module Lift Frame Assembly".

FIELD OF THE INVENTION

The present invention is directed to a module lift frame which is foldable so that it may be conveniently stored and transported without being disassembled, and so that it can be conveniently deployed for use.

BACKGROUND OF THE INVENTION

Heavy industrial plants, particularly in the bitumen, heavy oil and petrochemical industries are increasingly being constructed using pre-fabricated modules. A standard module comprises a structural steel frame, and may be 20 feet wide, 80 to 120 feet long, and up to 24 feet high, with weights ranging from 50 to 160 metric tons.

Conventionally, these modules are lifted and installed using cranes and rigging assemblies such as that shown in FIG. 1 (Prior Art). However, as the centre of gravity of the module may not coincide with the physical centre of the module, the rigging must be adjusted so that the module can be lifted with substantially equal tension in the rigging components. The large number of spreader bars, slings and shackles introduce a large number of potential pinch points, each of which carries a potential injury site. The complexity of the rigging causes lengthy delays while adjusting for the module centre of gravity and pick point configurations. The rigging does not provide any stiffness to the module causing significant stresses within the module for unequally loaded modules.

In the conventional rigging assemblies such as shown in FIG. 1 (Prior Art), the slings are provided in the form of flexible cables. When the rigging assembly is not in use, the cables should be detached from the spreader bars and properly stored to prevent their entanglement and for ease of transportation. When the rigging assembly is to be used, however, the cables must be re-attached to the spreader bars. Such operations delay the transportation and use of the rigging assembly.

Therefore, there is a need in the art for a module lift frame which mitigates the difficulties of the prior art.

SUMMARY OF THE INVENTION

In one aspect, the invention may comprise a module lift assembly comprising:

(a) a lift assembly;

(b) a first longitudinal lift beam and a second longitudinal lift beam transversely separated from the first lift beam; and (c) a first plurality of slings connecting the lift assembly to the first lift beam, and a second plurality of slings connecting the lift assembly to the second lift beam, wherein each sling is pivotally connected to the lift assembly and to the lift beam that is connected by the sling to the lift assembly, and comprises a plurality of pivotally connected elongate segments, wherein pivoting of the segments relative to each other, the lift assembly and the lift beams allows the lift assembly to be lowered and raised relative to the lift beams.

In one embodiment, at least two segments of each sling may be pivoted into overlapping relation to each other. When in overlapping relation to each other, the two segments may be in a substantially horizontal orientation, and substantially longitudinally aligned with the lift beam that is connected by the sling to the lift assembly.

In one embodiment, each sling consists of three segments.

In one embodiment, the plurality of segments comprises a first segment and a second segment, pivotally connected by a shackle. In another embodiment, the first and second segments may be pivotally connected by a double plate connector comprising a first plate, a second plate, and at least one pin spanning between the plates for retaining the first and second segments. The at least one pin may comprise a first pin for retaining the first segment and a second pin for retaining the second segment. In another embodiment, the first and second segments may be pivotally connected by a boom pendant thimble comprising a first member for retaining the first segment, and a second member for retaining the second segment, wherein the first member and the second member are pivotally connected.

In one embodiment, each sling further comprises an adjustable length member. Each sling adjustable length member may comprise a telescoping rod or flat bar and tube or rectangular shell assembly. Each sling may further comprise a turnbuckle for secondary length adjustment.

In one embodiment, the lift assembly comprises a first multipoint adapter plate and a second multipoint adapter plate separated by a transverse spreader bar, wherein the first and second multipoint adapter plates have an apex for attachment to the transverse spreader bar, and a plurality of attachment points for the first and second plurality of slings, respectively, arrayed on an arc opposite the apex. Each of the first and second multipoint adapter plate may comprise a pair of spaced apart plates and a plurality of pins or bolts separating the pair of spaced apart plates and forming the plurality of attachment points. The transverse spreader bar may comprise a lift ear disposed at each end of the transverse spreader bar, wherein each lift ear comprises a pivoting attachment to a crane hook, and a pivoting attachment to a shackle from which a different one of the multipoint adapter plates is suspended, wherein the pivoting attachments permit pivoting movement of the transverse spreader bar relative to the crane hook and the multipoint adapter plates about a horizontal axis, parallel to the lift beams. Each lift ear may comprise a single pivot pin as the pivoting attachment to both the crane hook and the shackle from which the different one of the multipoint adapter plates is suspended.

In one embodiment, the module lift assembly further comprises a plurality of slider assemblies, each of the slider assemblies slidably attaching a shackle for attaching a module to one of the lift beams. The plurality of slider assemblies may be interconnected along the one of the lift beam. The lift beam, such as an I-beam or a double web beam, may comprise an upper flange and a lower flange wherein the plurality of slings is attached to the upper flange, and wherein the plurality of slider assemblies is supported by the lower flange.

In one embodiment, the module lift assembly further comprises a supporting structure for supporting the lift assembly in a position such that the segments of the slings are pivoted into overlapping relation to each other. The supporting structure may comprise an A-frame and a pair of saddles for receiving a transverse spreader bar of the lift assembly.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS OF THE INVENTION

The invention relates to an adjustable module lift frame assembly. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

Figure 1:
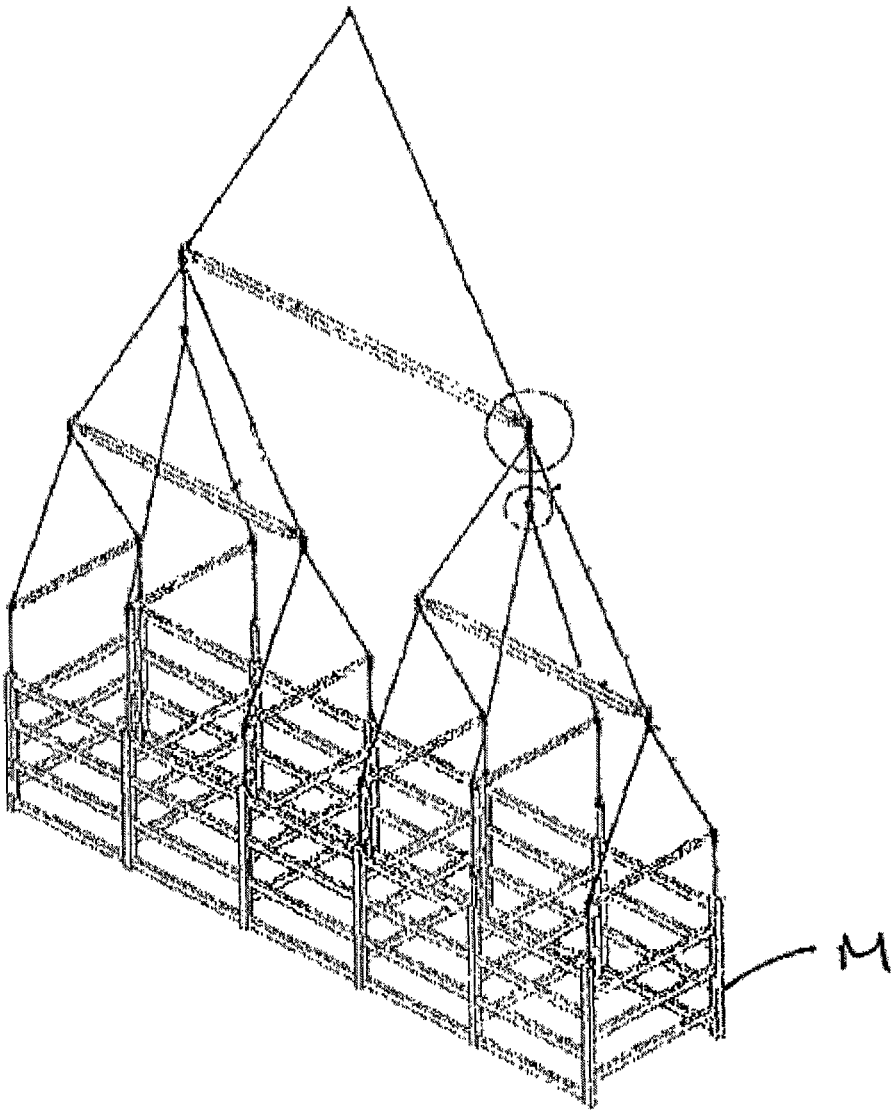
FIG. 1 PRIOR ART
FIG. 1 is diagram of a prior art module lift rigging assembly.

As shown in FIG. 1, a prior art rigging assembly includes spreader bars oriented in both the longitudinal and transverse directions. Adjusting the rigging to accommodate a non-centred centre of gravity (COG) involves multiple adjustments of various rigging components.

Figure 2:
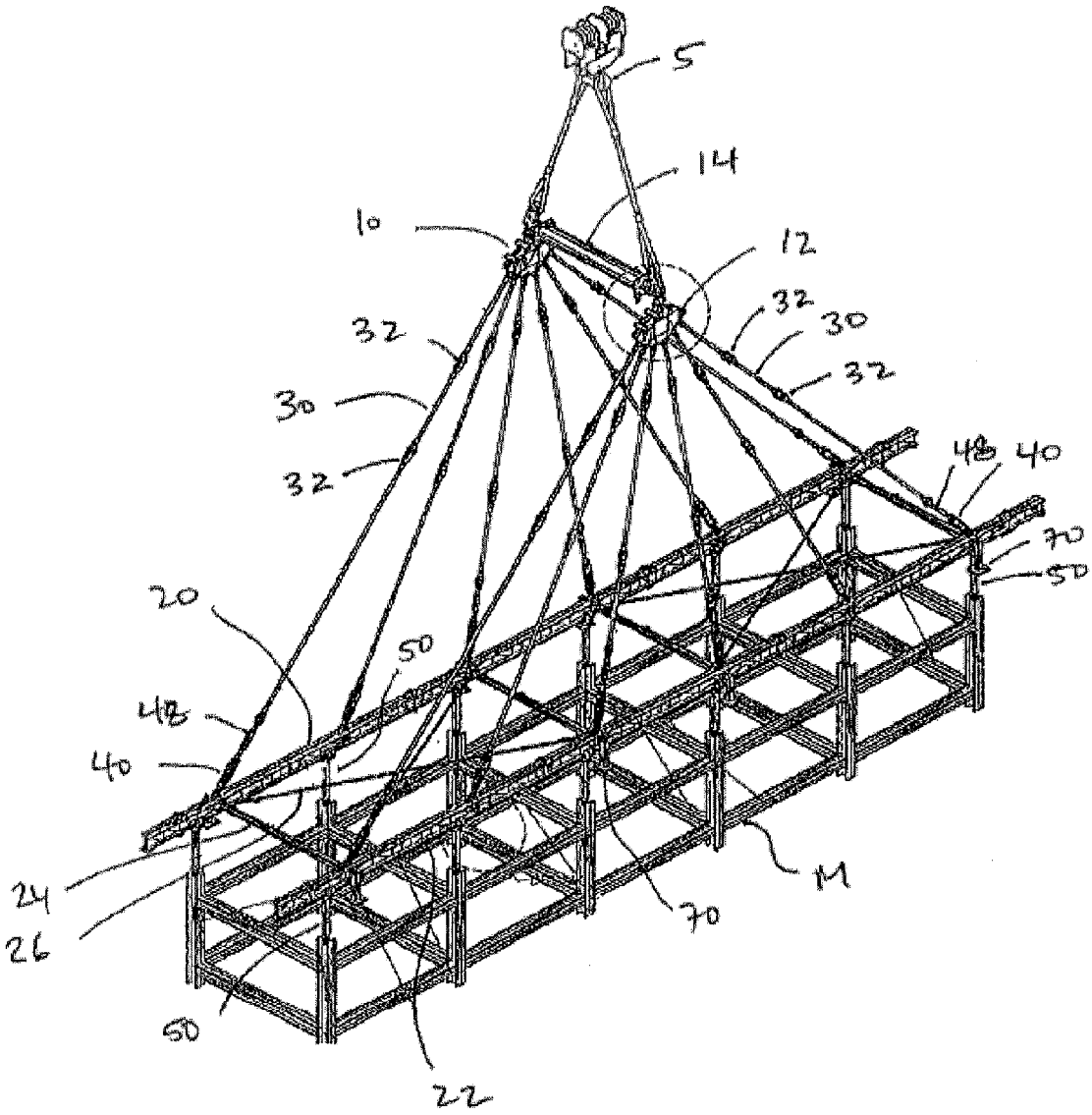
FIG. 2 shows one embodiment of a module lift assembly of the present invention.

In one embodiment of the present invention as shown in FIG. 2, a module (M) lift frame assembly comprises:

(a) an upper lift assembly comprising a first and second multipoint adapter plates (10, 12) separated by a transverse spreader bar (14);

(b) a lift frame comprising first and second longitudinal lift beams (20, 22) separated by transverse bracing (24) and diagonal bracing (26);

(c) a plurality of slings (30) connecting the first multipoint adapter plate (10) to the first lift beam (20) and connecting the second multipoint adapter plate (12) to the second lift beam (22), wherein each sling (30) comprises a member of adjustable length (40); and (d) a plurality of slider assemblies (50) each having a first end (52) slidingly affixed to either the first or second lift beams (20, 22), and a second end (54) comprising a lift shackle (56) for attaching to the module (M) being lifted.

Figure 3:
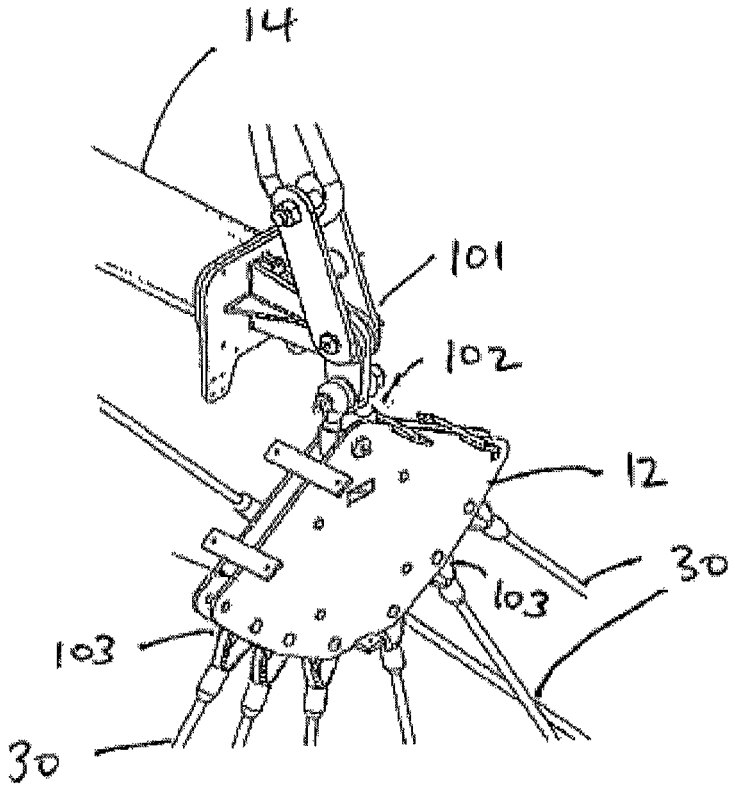
FIG. 3 shows a detail of FIG. 2, showing one embodiment of a multipoint adapter plate.
Figure 4:
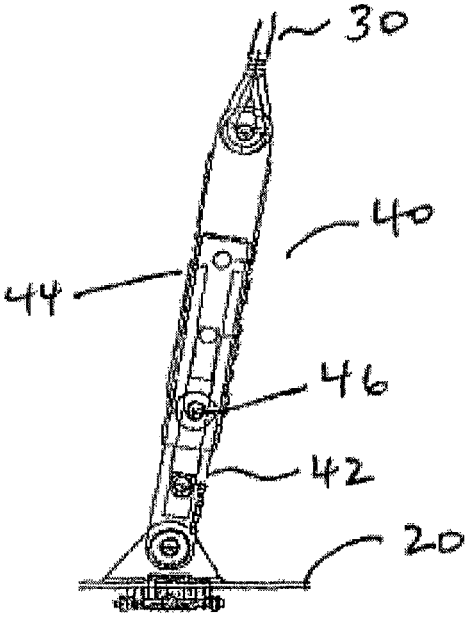
FIG. 4 shows one embodiment of an adjustable length member for attachment between one embodiment of the slings and the lift beam.
Figure 5:
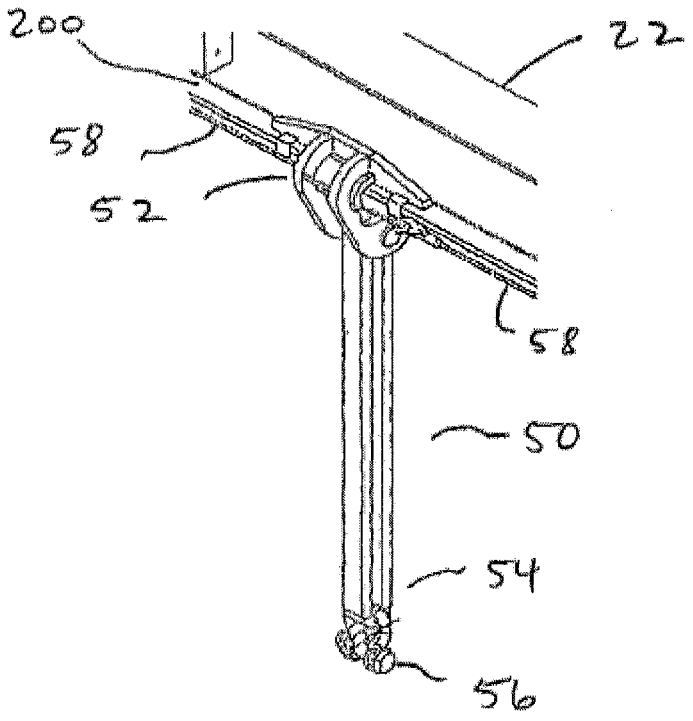
FIG. 5 shows one embodiment of a slider assembly.

The upper lift assembly connects to a crane hook (5) which is attached by wire rope to either end of the transverse spreader bar (14). First and second multipoint adapter plates (10, 12) are attached to lift ears (101), as can be seen in FIG. 3, disposed at the ends of the transverse spreader bar (14).

In one embodiment, each multipoint adapter plate (10, 12) comprises a pair of parallel plates spaced apart with pins or bolts. Each adapter plate has an apex which accepts and hangs from a shackle (102) connected to the lift ear (101). A plurality of sling attachments (103) are arrayed in an arc opposite the apex, as may be seen in FIG. 3.

The lift frame comprises first and second horizontal longitudinal lift beams (20, 22) separated by transverse bracing (24) and diagonal bracing (26). In one embodiment, the longitudinal lift beams comprise I-beams or double web beams having a lower flange (200). Each lift beam may be a single unitary beam or may comprise multiple interconnected lift beams. The lift frame is connected to the adapter plates (10, 12) by a plurality of slings (30) connecting the first multipoint adapter plate (10) to the first lift beam (20), and a plurality of slings (30) connecting the second multipoint adapter plate (12) to the second lift beam (22). Each length of sling (30) may comprise a number of sling segments interconnected with intermediate shackles (32) or connector plates, and are attached to an upper surface of each lift beam. Preferably, the lift assembly comprises an even number of slings, distributed between the first and second adapter plates and lift beams. Preferably, the slings attach to the lift beams in fixed positions, spaced in equidistant manner along the length of the lift beams.

Each sling (30) further comprises at least one member of adjustable length (40). In a preferred embodiment, the adjustable length member (40) comprises a telescoping rod (42) and tube (44), or flat bar and rectangular shell arrangement, which may be fixed in various relative positions with a removable pin (46) that may be inserted through apertures of the rod (42) and tube (44) that may be selectively aligned. Secondary length adjustment may be provided by a turnbuckle (48) which may be connected to the sling immediately above or below the adjustable length member (40).

Each lower flange of each lift beam (20, 22) supports a plurality of slider assemblies (50), which each have a first end (52) slidingly affixed to the lift beam (20, 22) lower flanges, and a second end (54) comprising a lift shackle (56). The lift shackle (56) provides the connection to the module (M) being lifted.

As will be apparent to one skilled in the art, the number and placing of the slider assemblies is dependent upon the module (M) being lifted. In one exemplary embodiment shown in FIG. 2, the module (M) comprises 6 columns along each longitudinal side, therefore, there are 6 slider assemblies on each lift beam, each of which connects to a column. In one embodiment, the slider assemblies on each lift beam are linearly interconnected by means of cables (58) or rods, so that the slider assemblies move in unison along the length of the lift beam. In other words, the distance between adjacent slider assemblies remains constant as they are moved along the lift beam.

In one embodiment, the lift assembly may comprise a plurality of legs (70) along the lift beams (20, 22) upon which the lift assembly may rest upon for storage when the assembly is not in use. These legs may be permanently attached in a position which does not interfere with the use of the assembly, or may be detachable.

In the embodiment illustrated in FIG. 2, the lift beams (20, 22) are of unitary construction. In alternative embodiments, the lift beams may be multi-component spliced beams, which may provide the ability to shorten or lengthen the lift beams as necessary or desired.

In operation, the lift assembly may be adjusted so as to place the COG of the module (M) immediately below (vertically aligned) with the centre of the upper lift assembly, which will be the midpoint of the spreader bar (14).

Figure 6:
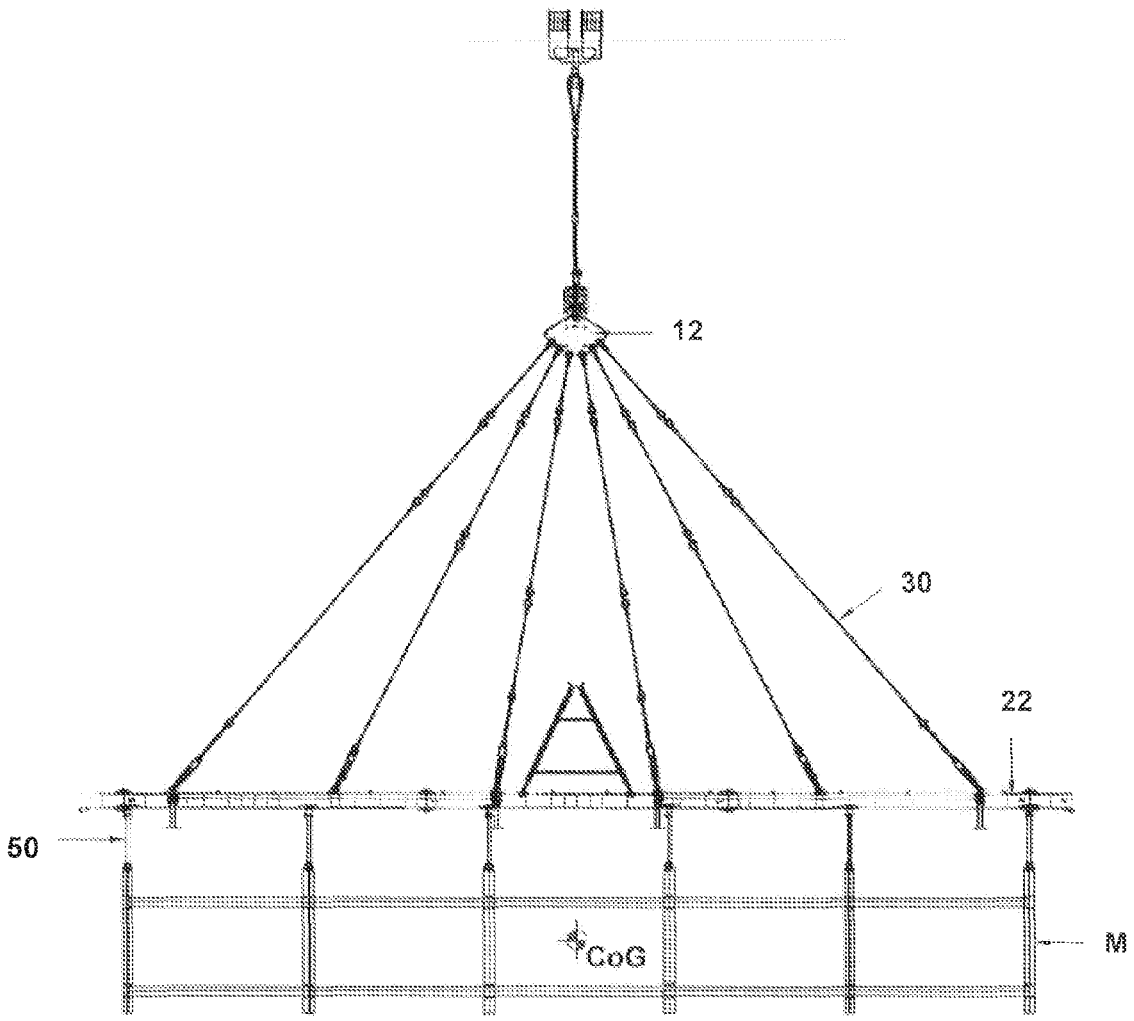
FIG. 6 shows a side view of one embodiment of the adjustment of the slider assemblies for a module having an offset centre of gravity.

In the longitudinal direction, this may be accomplished by moving the sliding assemblies along each lift beam, such as by using a winch or other suitable machine, until the COG of the module is vertically aligned with the apex of the first and second adapter plates, as is shown in FIG. 6.

Figure 7:
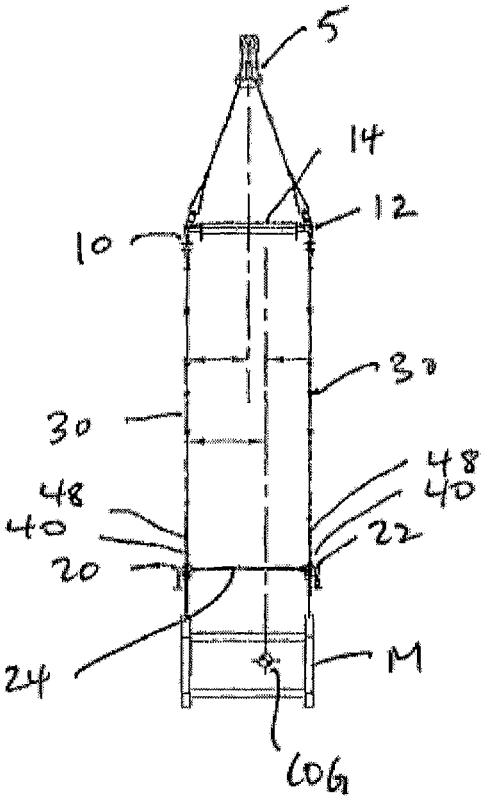
FIG. 7 shows an end view of one embodiment of the assembly before adjustment of the length of the sling assemblies for a module having an offset centre of gravity.

In the transverse direction, this may be accomplished by lengthening or shortening the slings one of the lift beams, such as by moving the pin (46) from one aperture to another aperture of the adjustable length member (40) and using the turnbuckle (48). As may be seen in FIG. 7, the COG of the module may be shifted towards the midpoint of the spreader bar (14) by shortening the adjustable length members (40) of the slings attached between the first adapter plate (10) and the first lift beam (20) and/or lengthening the adjustable length members (40) of the slings attached between the second adapter plate (12) and the second lift beam (22). This shortening or lengthening of the adjustable length members (40) of the slings attached to a lift beam will modify the relative vertical position of a lift beam, as compared to the other lift beam.

In one embodiment of the present invention as shown in FIGS. 8-14, the module lift assembly comprises:

(a) a lift assembly (8);

(b) a first longitudinal lift beam (20) and a second longitudinal lift beam (22) transversely separated from the first lift beam (20); and (c) a first plurality of slings (30) connecting the lift assembly (8) to the first lift beam (20), and a second plurality of slings (31) connecting the lift assembly (8) to the second lift beam (22), wherein each sling (30, 31) is pivotally connected to the lift assembly (8) and to the lift beam (20, 22) that is connected by the sling to the lift assembly, and comprises a plurality of pivotally connected segments (80, 82, 84), wherein pivoting of the segments relative to each other, the lift assembly (8), and the lift beams (20, 22) allow the lift assembly (8) to be lowered and raised relative to the lift beams (20, 22).

Figure 10:
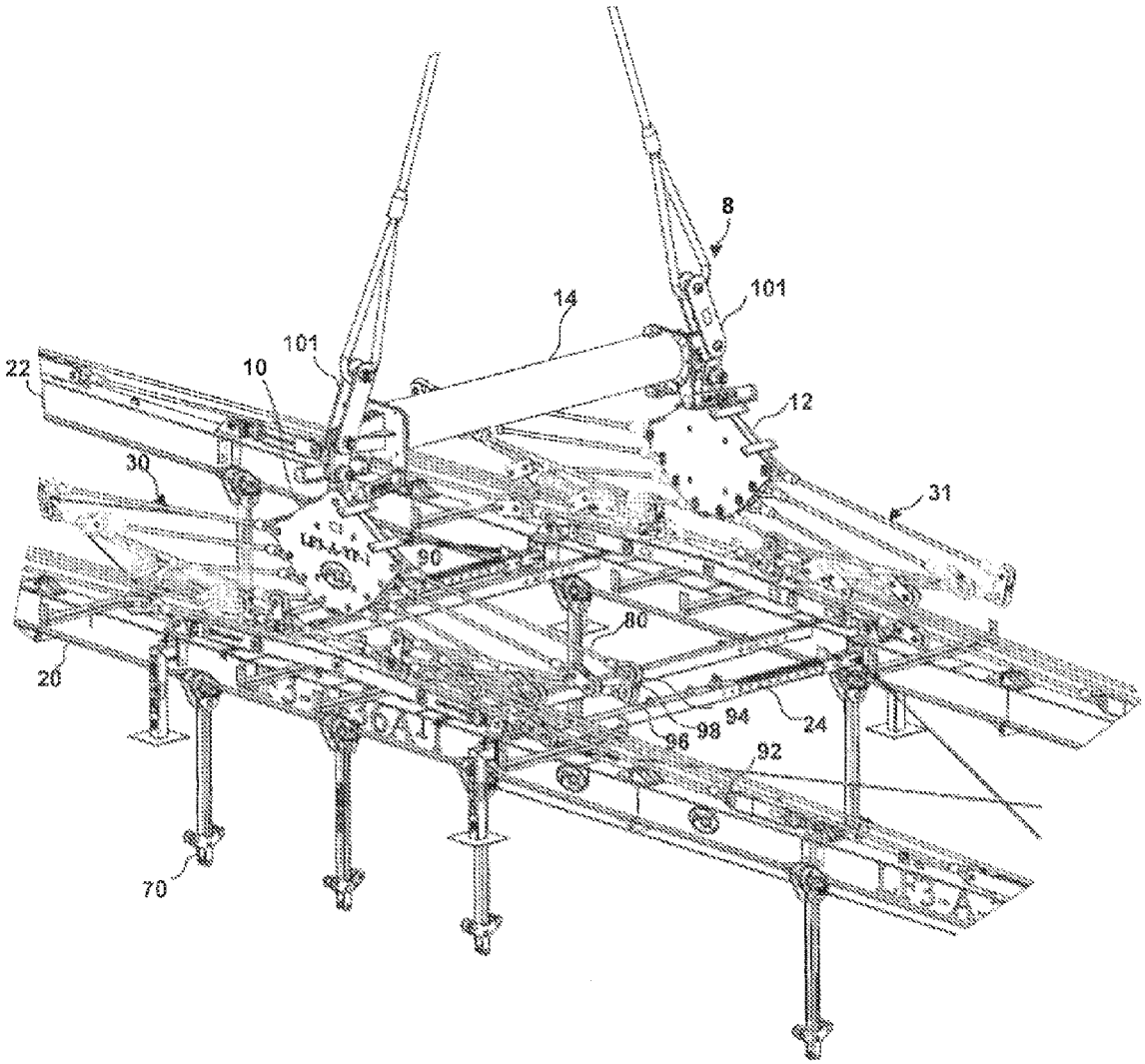
FIG. 10 shows a detailed perspective view of the lift assembly and slings when the module lift assembly is in the stowed configuration shown in FIG. 9.
Figure 12:
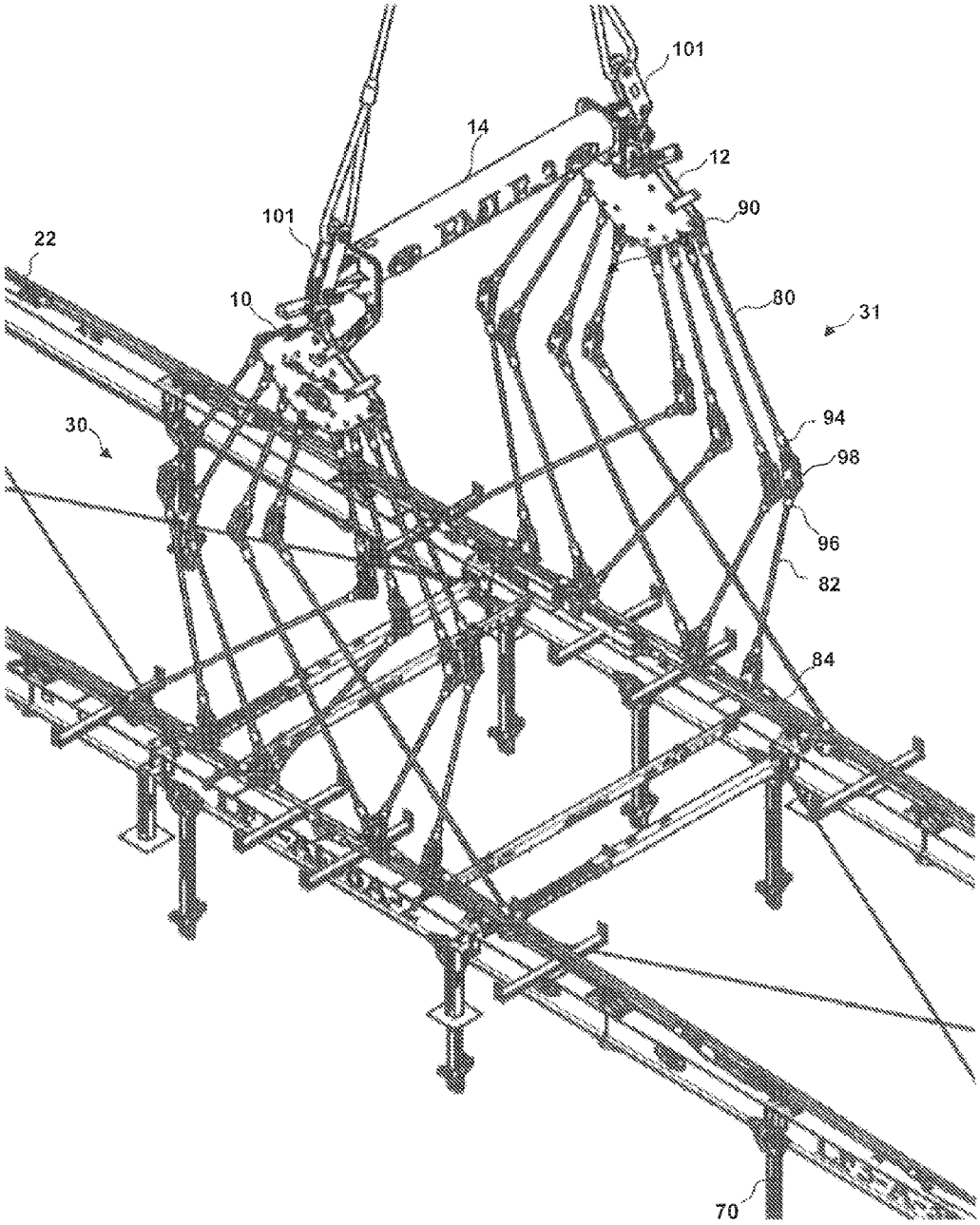
FIG. 12 shows a detailed perspective view of the lift assembly and slings when the module lift assembly is in the first intermediate configuration shown in FIG. 11.

The lift assembly (8) attaches to a crane hook (5) or other lifting device. In one embodiment as can be seen in FIGS. 10 and 12, the lift assembly (8) comprises first and second multipoint adapter plates (10, 12) separated by a transverse spreader bar (14), and lift ears (101). In embodiments, the lift assembly (8) and its constituent components may have features as described above in relation to the embodiments of the module lift assembly shown in FIG. 2.

Figure 8:
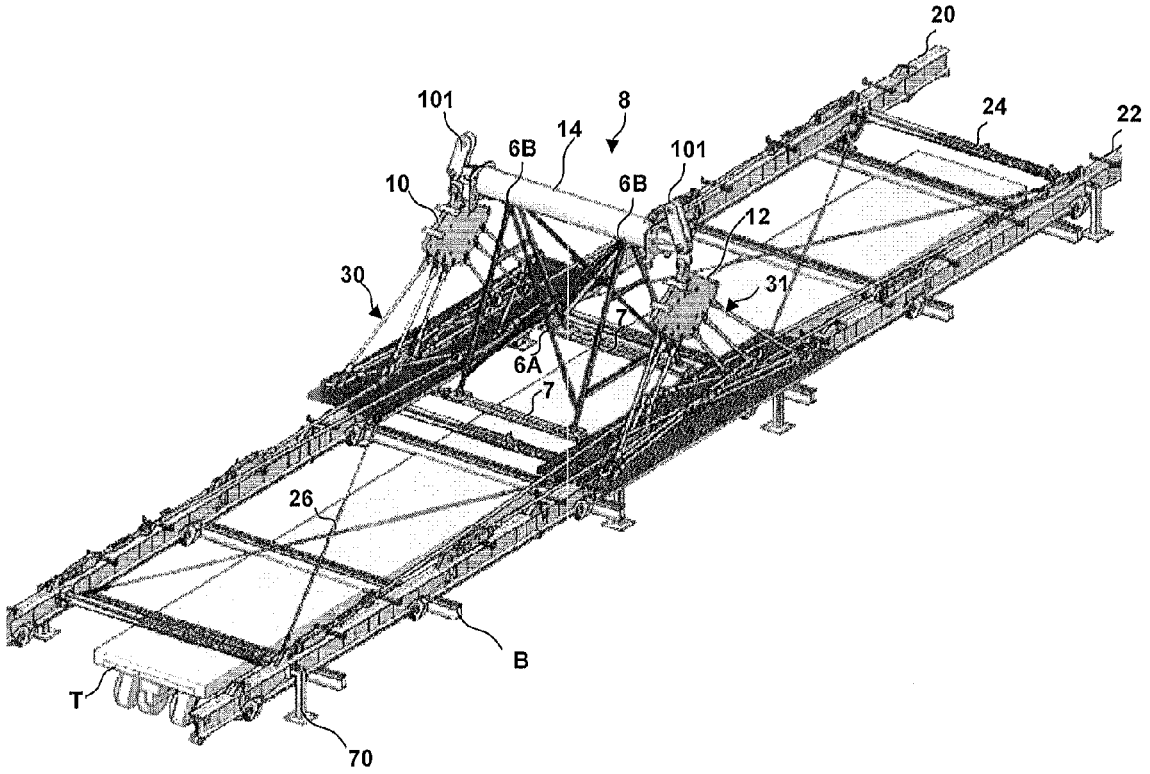
FIG. 8 shows a perspective view of an alternative embodiment of the module lift assembly of the present invention, in the stowed configuration, when loaded onto a transporter or in storage awaiting further use.

The first and second horizontal longitudinal lift beams (20, 22) provide elongate members to which the module is attached by the attachment means. In one embodiment as shown in FIG. 8, the lift beams (20, 22) comprise I-beams, and are transversely separated by transverse bracing (24) and diagonal bracing (26) to form a lift frame. In embodiments, the lift frame and its constituent components may have features as described above in relation to the embodiments of the module lift assembly shown in FIG. 2.

The attachment means permit the module to be attached to the lift beams (20,22). In one embodiment, the attachment means comprise lift shackles (56) with attached slider assemblies (50), and may comprise additional features as described above in relation to embodiments of the module lift assembly shown in FIG. 2. In other embodiments, the attachment means may comprise any suitable means known in the art for attaching the module to the lift beams (20,22).

The slings (30, 31) transfer the weight of module (M) from the first and second lift beams (20, 22) to the lift assembly (8). Each of the slings (30, 31) has one end pivotally connected to the lift assembly (8) and an opposite end pivotally connected to first and second lift beams (20, 22), respectively, so as to permit rotation of the segments (80, 84) of the slings (30, 31) about horizontal axes. In one embodiment as can be seen in FIGS. 10 and 12, the end of each of the slings (30, 31) terminates in a loop (90) that is retained by one of the pins or bolts that separates the plates of the multipoint adapter plates (101) of the lift assembly (8). The opposite end of each of the slings (30, 31) terminates in a loop (92) that is retained by the removable pin (46) of an adjustable length member (40), as described above. In other embodiments, the slings (30, 31) may be pivotally connected to the lift beams (20, 22) and the lift assembly (8) using any suitable means known in the art, so long as such connections allow the segments (80, 84) to rotate about horizontal axes, relative to the lift assembly (8) and the connected lift beams (20, 22).

Figure 14:
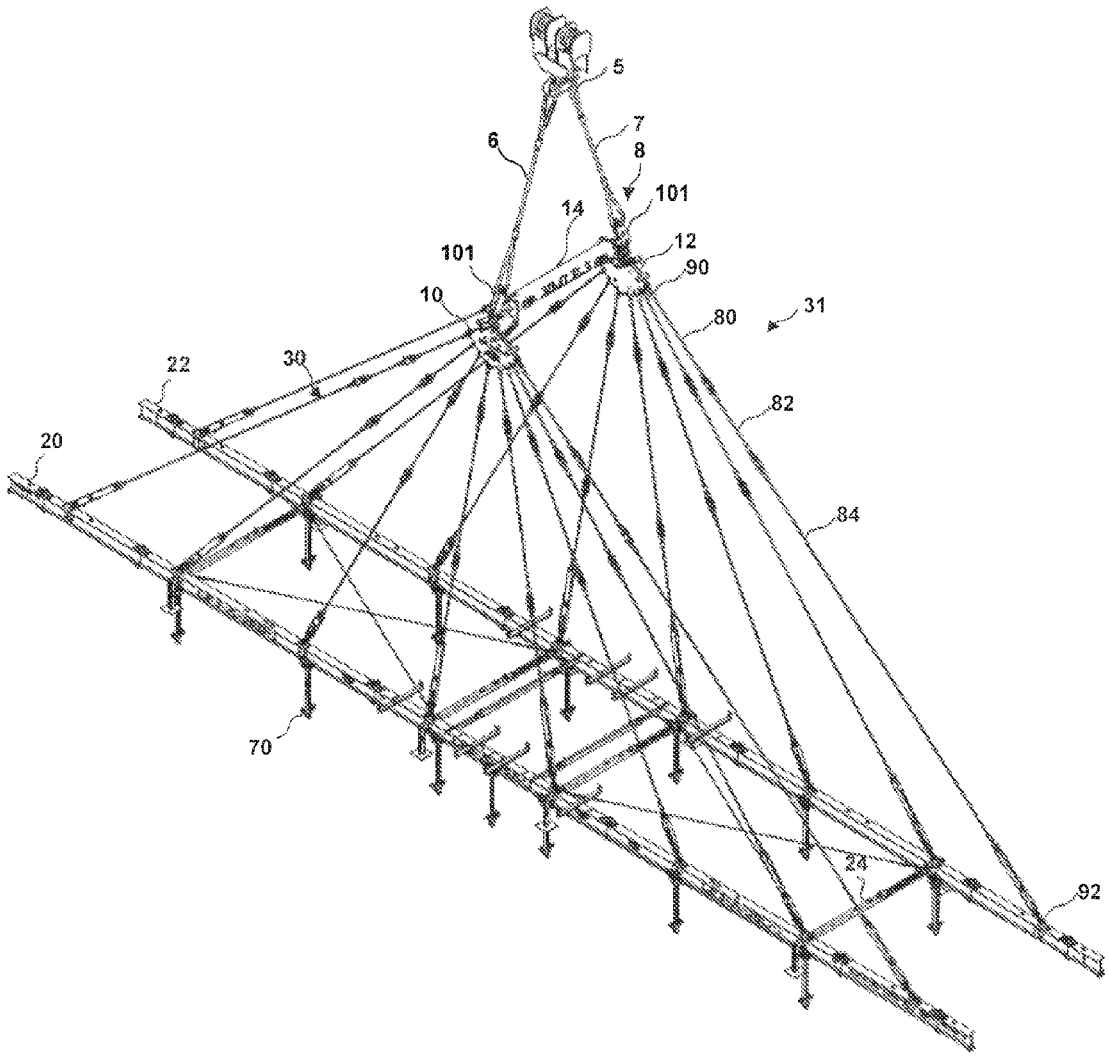
FIG. 14 shows a perspective view of the embodiment of the module lift assembly shown in FIG. 8 in a deployed configuration, when connected to a crane hook.

Each of the slings (30, 31) is articulated, being formed by a plurality of pivotally connected segments. In one embodiment as can be seen in FIG. 14, each sling comprises three segments (80, 82, 84). In other embodiments, each sling (30, 31) may comprise two segments or a greater number of segments. Each of the segments (80, 82, 84) may be formed by a length of wire rope. In one embodiment as can be seen in FIGS. 10 and 12, the adjacent ends of connected segments (80, 82) terminate in loops (94, 96), and in other embodiments, may terminated in a wire rope end fitting. In one embodiment, a shackle (98) passes through both loops (94, 96) to pivotally connect segments (80, 82). Segments (82, 84) of the slings (30, 31) are pivotally connected to each other in the same manner. In other embodiments, the segments (80, 82, 84) may be pivotally connected to each other using any suitable means known in the art, so long as such connection allows the segments (80, 82, 84) to rotate about horizontal axes, relative to each other.

Figure 15:
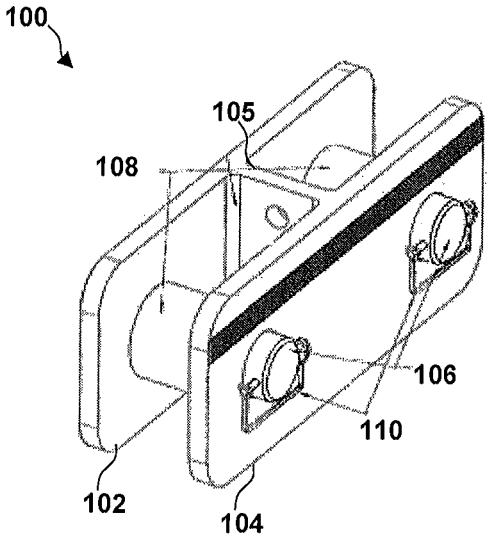
FIG. 15 shows a double plate connector for connecting two segments of a sling.
Figure 16:
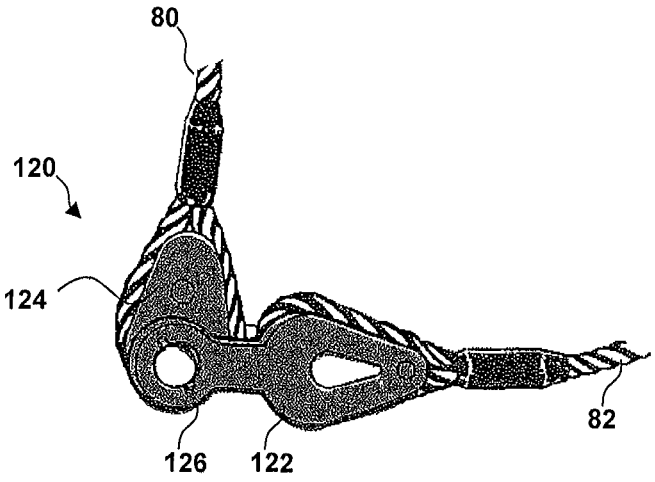
FIG. 16 shows a boom pendant thimble for connecting two segments of a sling.

In an alternative embodiment as shown in FIG. 15, two segments of a sling may be pivotally connected by a double plate connector (100) comprising plates (102) and (104), which are integrally joined by a welded intermediate member (105). In one embodiment, the double plate connector has two pins (106), each of which retains one of the segments and spans between the plates (102, 104) so that the ends of the segments are received between the plates (102, 104). Each of the pins (106) has a bushing (108), and is retained in an aperture formed in the plates (102, 104) by a snapper pin (110). In an alternative embodiment as shown in FIG. 16, the two segments of a sling may be pivotally connected by a boom pendant thimble (120) comprising a first retaining member (122) and a second retaining member (124), pivotally connected by a clevis fastenener (126).

The use and operation of the embodiment of the module lift assembly shown in FIGS. 8 to 14 is now described. In FIG. 8, the module lift assembly, as shown in a stowed configuration, rests on a plurality of transversely spanning beams (B) that in turn, rest upon a transporter (T). In embodiments, the transporter (T) may be a wheeled trailer that may towed by a truck, or may be a self-propelled modular transporter (SMPT) as is known in the art. Once the module lift assembly has been delivered to its desired destination, the plurality of legs (70) along the lift beams (20, 22) are lowered into position to support the module lift assembly on a ground surface. As shown in FIG. 8, the transverse spreader bar (14) rests on a supporting structure (6) which comprises an "A" frame (6A) and a pair of saddles (6B) which contact and support the transverse spreader bar (14). The legs of the "A" frame rest on a pair of beams (7) that connect to the lift beams (20, 22).

Figure 9:
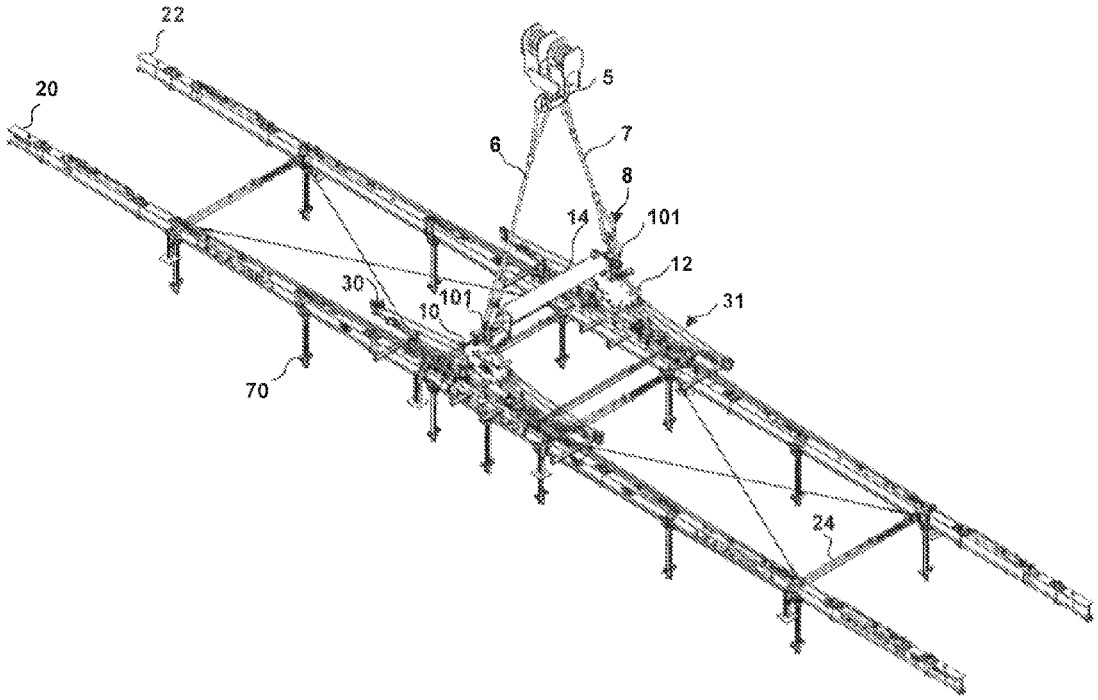
FIG. 9 shows a perspective view of the embodiment of the module lift assembly shown in FIG. 8 in the stowed configuration, when connected to a crane hook.

In FIG. 9, the transporter (T) has been lowered and moved away from the module lift assembly, the "A" frame (6) has also been removed, and a crane hook (5) is attached by slings (6, 7) to the lift ears (101). In FIGS. 9 and 10, the module lift assembly is in an initial stowed configuration. It will be noted that the slings (30, 31) are substantially longitudinally aligned with the connected lift beams (20, 22) and contained within the footprint of the lift frame. Further, the lengths of the segments (80, 82, 84) of each sling (30, 31) are selected such that the segments (80, 82, 84) are in overlapping relation to each other and are in a substantially horizontal orientation. As used herein, two segments are in "overlapping" relation to each other when a plane oriented perpendicularly to the elongate direction of at least one of the segments, intersects both segments. This allows the lift assembly (8) to be disposed immediately above the lift beams (20, 22) in a relatively compact vertical configuration.

Figure 11:
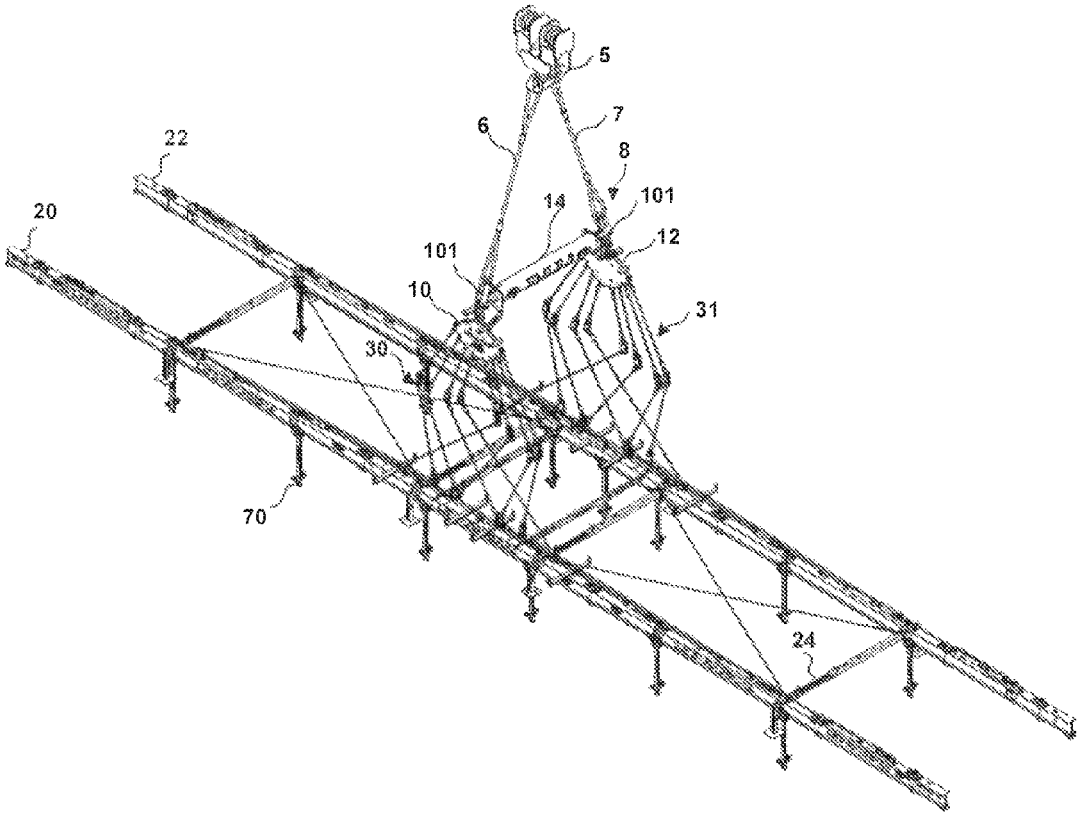
FIG. 11 shows a perspective view of the embodiment of the module lift assembly shown in FIG. 8 in a first intermediate configuration, when connected to a crane hook.

As shown in FIGS. 11 and 12, the crane (not shown) has pulled upwardly on the crane hook (5) to move the module lift assembly into a first intermediate configuration. The pulling force of the crane is transmitted by the slings (6, 7) to the lift assembly (8), and then by the bolts or pins of the multipoint adapter plates (10, 12) to the plurality of slings (30, 31). The pivotal connections between the segments (80, 82, 84), the lift module (8), the lift beams (20, 22) and themselves allow the segments (80, 82, 84) to rotate into more vertical orientations while the lift beams (20, 22) remain resting on the ground surface.

Figure 13:
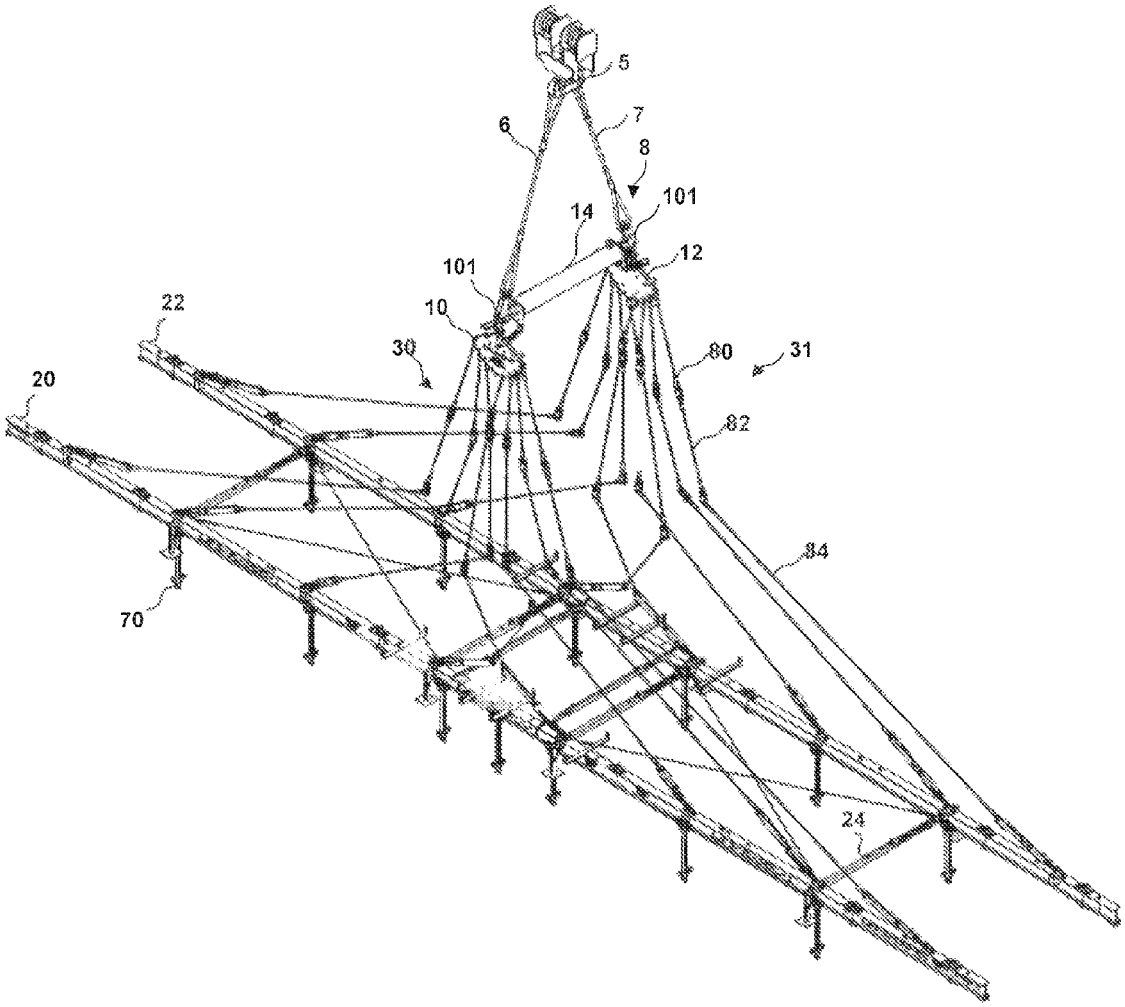
FIG. 13 shows a perspective view of the embodiment of the module lift assembly shown in FIG. 8 in a second intermediate configuration, when connected to a crane hook.

As shown in FIG. 13, the continued upward pulling force applied by the crane (not shown) on the crane hook (5) has moved the module lift assembly into a second intermediate configuration. The pivoting of the segments (80, 82, 84) continues until the module lift assembly reaches a deployed configuration as shown in FIG. 14. For efficient use of each of the slings (30, 31), the length of their segments (80, 82, 84) are selected so that they aligned collinearly in end-to-end fashion in the deployed configuration. In this manner, each of the slings (30, 31) will be involved in transmitting the weight of the module (M) from the lift beams (20, 22) to the lift assembly (8).

Once the module lift assembly is in the deployed configuration, the geometric constraint imposed by the slings (30, 31) will prevent the continued upward pulling force applied by the crane (not shown) on the crane hook (5) from raising the lift assembly (8) relative to the lift beams (20, 22). Rather, the slings (30, 31) will transmit the pulling force from the lift assembly (8) to the lift beams (20, 21), so as to lift the module lift assembly in its entirety from the ground surface. At this stage, the module lift assembly may be positioned over the module and the module can be secured to the lift beams (20, 22) by the attachment means. The centre of gravity (COG) of the module may then be aligned with the lift assembly (8) by making adjustments to the module lift assembly, in the same manner as described above in respect to the embodiment of the module lift assembly shown in FIG. 2.

Once the module has been lifted, positioned in place, and detached from the module lift assembly, the crane (not shown) is used to lower the module lift assembly to rest on the ground surface. The pivotal connections between the segments (80, 82, 84), the lift module (8), the lift beams (20, 22) and themselves allow the segments (80, 82, 84) to rotate into more horizontal orientations while the lift beams (20, 22) remain resting on the ground surface, until the module lift assembly returns to the stowed configuration as shown in FIG. 9, with the transverse spreader bar (14) resting on the saddles (6A, 6B) of the supporting structure (6).

It will be apparent that the embodiment of the module lift assembly shown in FIGS. 8 to 14 can be conveniently folded into a relatively compact configuration so that it may be stored or transported on a transporter, and then unfolded in an expanded deployed configuration when ready for use. In particular, the module lift assembly avoids the need to detach the slings (30, 31) from the module lift assembly prior to its storage and transport since the slings (30, 31) may be configured to remain within the footprint of the lift frame at all times.

As will be apparent to those skilled in the art, various modifications, adaptations and variations of the foregoing specific disclosure can be made without departing from the scope of the invention claimed herein.

What is claimed is:

1. A module lift assembly comprising:

(a) a lift assembly;

(b) a first longitudinal lift beam and a second longitudinal lift beam transversely separated from the first lift beam; and (c) a first plurality of slings connecting the lift assembly to the first lift beam, and a second plurality of slings connecting the lift assembly to the second lift beam, wherein each sling is pivotally connected to the lift assembly and to the lift beam that is connected by the sling to the lift assembly, and comprises a plurality of pivotally connected elongate segments, wherein pivoting of the segments relative to each other, the lift assembly and the lift beams allows the lift assembly to be lowered and raised relative to the lift beams;

(d) wherein the plurality of segments comprises a first segment and a second segment, pivotally connected by a boom pendant thimble comprising a first member for retaining the first segment, a second member for retaining the second segment, wherein the first member and the second member are pivotally connected.

2. The module lift assembly of claim 1 wherein at least two segments of each sling may be pivoted into overlapping relation to each other.

3. The module lift assembly of claim 2 wherein the at least two segments are in a substantially horizontal orientation when in overlapping relation to each other.

4. The module lift assembly of claim 2 wherein at least two segments of each sling are substantially longitudinally aligned with the lift beam that is connected by the sling to the lift assembly when in overlapping relation to each other.

5. The module lift assembly of claim 1 wherein each sling consists of three segments.

6. A module lift assembly comprising:

(a) a lift assembly;

(b) a first longitudinal lift beam and a second longitudinal lift beam transversely separated from the first lift beam; and (c) a first plurality of slings connecting the lift assembly to the first lift beam, and a second plurality of slings connecting the lift assembly to the second lift beam, wherein each sling is pivotally connected to the lift assembly and to the lift beam that is connected by the sling to the lift assembly, and comprises a plurality of pivotally connected elongate segments, wherein pivoting of the segments relative to each other, the lift assembly and the lift beams allows the lift assembly to be lowered and raised relative to the lift beams;

(d) wherein each sling further comprises an adjustable length member comprising a telescoping rod or flat bar and tube or rectangular shell assembly.

7. The module lift assembly of claim 6 wherein each sling further comprises a turnbuckle for secondary length adjustment.

8. A module lift assembly comprising:

(a) a lift assembly comprising a first multipoint adapter plate and a second multipoint adapter plate separated by a transverse spreader bar, wherein the first and second multipoint adapter plates have an apex for attachment to the transverse spreader bar, and a plurality of attachment points for a first and second plurality of slings, respectively, arrayed on an arc opposite the apex;

(b) a first longitudinal lift beam and a second longitudinal lift beam transversely separated from the first lift beam; and (c) the first plurality of slings connecting the lift assembly to the first lift beam, and the second plurality of slings connecting the lift assembly to the second lift beam, wherein each sling is pivotally connected to the lift assembly and to the lift beam that is connected by the sling to the lift assembly, and comprises a plurality of pivotally connected elongate segments, wherein pivoting of the segments relative to each other, the lift assembly and the lift beams allows the lift assembly to be lowered and raised relative to the lift beams.

9. The module lift assembly of claim 8 wherein each of the first and second multipoint adapter plate comprises a pair of spaced apart plates and a plurality of pins or bolts separating the pair of spaced apart plates and forming the plurality of attachment points.

10. The module lift assembly of claim 8 wherein the transverse spreader bar comprises a lift ear disposed at each end of the transverse spreader bar, wherein each lift ear comprises a pivoting attachment to a crane hook, and a pivoting attachment to a shackle from which a different one of the multipoint adapter plates is suspended, wherein the pivoting attachments permit pivoting movement of the transverse spreader bar relative to the crane hook and the multipoint adapter plates about a horizontal axis, parallel to the lift beams.

11. The module lift assembly of claim 10 wherein each lift ear comprises a single pivot pin as the pivoting attachment to both the crane hook and the shackle from which the different one of the multipoint adapter plates is suspended.

12. A module lift assembly comprising:

(a) a lift assembly;

(b) a first longitudinal lift beam and a second longitudinal lift beam transversely separated from the first lift beam;

(c) a first plurality of slings connecting the lift assembly to the first lift beam, and a second plurality of slings connecting the lift assembly to the second lift beam, wherein each sling is pivotally connected to the lift assembly and to the lift beam that is connected by the sling to the lift assembly, and comprises a plurality of pivotally connected elongate segments, wherein pivoting of the segments relative to each other, the lift assembly and the lift beams allows the lift assembly to be lowered and raised relative to the lift beams; and (d) a plurality of slider assemblies interconnected along one of the lift beams, each of the slider assemblies slidably attaching a shackle for attaching a module to one of the lift beams.

13. The module lift assembly of claim 12 wherein the one lift beam comprises an upper flange and a lower flange, wherein the plurality of slings is attached to the upper flange, and wherein the plurality of slider assemblies is supported by the lower flange.

14. The module lift assembly of claim 13 wherein the one lift beam comprises an I-beam or a double web beam.

15. A module lift assembly comprising:

(a) a lift assembly;

(b) a first longitudinal lift beam and a second longitudinal lift beam transversely separated from the first lift beam; and (c) a first plurality of slings connecting the lift assembly to the first lift beam, and a second plurality of slings connecting the lift assembly to the second lift beam, wherein each sling is pivotally connected to the lift assembly and to the lift beam that is connected by the sling to the lift assembly, and comprises a plurality of pivotally connected elongate segments, wherein pivoting of the segments relative to each other, the lift assembly and the lift beams allows the lift assembly to be lowered and raised relative to the lift beams; and (d) a supporting structure for supporting the lift assembly in a position such that the segments of the slings are pivoted into overlapping relation to each other.

16. The module lift assembly of claim 15 wherein the supporting structure comprises an A-frame and a pair of saddles for receiving a transverse spreader bar of the lift assembly.

17. The module lift assembly of claim 6, 8, 12 or 15 wherein the plurality of segments comprises a first segment and a second segment, pivotally connected by a shackle or a double plate connector comprising a first plate, a second plate, and at least one pin spanning between the plates for retaining the first and second segments.

18. The module lift assembly of claim 17 wherein the at least one pin comprises a first pin for retaining the first segment, and a second pin for retaining the second segment.

19. The module lift assembly of claim 17 wherein each sling consists of three segments.

* * * * *